US006439732B1

(12) United States Patent
Weisbach et al.

(10) Patent No.: US 6,439,732 B1
(45) Date of Patent: Aug. 27, 2002

(54) THEFT-PROOF REMOVABLE DOOR HANDLE ILLUMINATION DEVICE

(76) Inventors: Mark A. Weisbach; Dee Weisbach, both of 518 S. 13th St., Lexington, MO (US) 64067

( * ) Notice: Subject to any disclaimer, the term of this patent is extended or adjusted under 35 U.S.C. 154(b) by 78 days.

(21) Appl. No.: 09/678,011

(22) Filed: Oct. 3, 2000

Related U.S. Application Data

(60) Provisional application No. 60/157,527, filed on Oct. 4, 1999.

(51) Int. Cl.[7] ..... E05B 17/10

(52) U.S. Cl. ..... 362/100; 362/226; 362/368; 362/428; 362/194; 362/430

(58) Field of Search ..... 362/100, 226, 362/368, 427, 428, 430, 287, 194

(56) References Cited

U.S. PATENT DOCUMENTS

| | | | | |
|---|---|---|---|---|
| 500,026 | A | | 6/1893 | Morey |
| 2,732,480 | A | | 1/1956 | Wells, II |
| 2,765,396 | A | | 10/1956 | Iverson |
| 2,813,195 | A | | 11/1957 | Willey et al. |
| 2,842,657 | A | | 7/1958 | Ford |
| 3,590,234 | A | | 6/1971 | Bartick |
| 3,787,677 | A | | 1/1974 | Molitor |
| 4,293,894 | A | | 10/1981 | Blank |
| 4,310,873 | A | | 1/1982 | Bean |
| 4,475,067 | A | | 10/1984 | Rowe |
| 4,533,985 | A | | 8/1985 | Jasinski |
| 4,777,570 | A | | 10/1988 | Littles |
| 4,779,171 | A | | 10/1988 | Ferguson |
| 4,872,095 | A | * | 10/1989 | Dubak et al. ..... 362/100 |
| 5,179,325 | A | | 1/1993 | Aragon, Jr. |
| 5,499,171 | A | | 3/1996 | Simpson et al. |
| 5,535,104 | A | | 7/1996 | Maffey et al. |
| 5,634,710 | A | | 6/1997 | Di Russo et al. |
| 5,803,581 | A | | 9/1998 | Brockmann |

* cited by examiner

*Primary Examiner*—Sandra O'Shea
*Assistant Examiner*—David V. Hobden
(74) *Attorney, Agent, or Firm*—Hovey Williams LLP

(57) ABSTRACT

A theft-proof removable door handle illumination device having a base, a door handle illumination assembly, and a case supporting the assembly. The base is operable to be mounted on a mounting surface. The door handle illumination assembly is operable to provide illumination. The case and base are removably interconnected such that disconnection of the case from the base requires movement of the case in a disconnect direction that is at least substantially parallel to the mounting surface. The case and base cooperate when interconnected to prevent movement of the case in a direction generally perpendicular to the disconnect direction. With this arrangement, the device is easily associated with a door assembly so that movement of the case in the disconnect direction is permitted only when the door is open. The case, once removed, can be used for illumination purposes apart from the door (e.g., a flashlight).

31 Claims, 4 Drawing Sheets

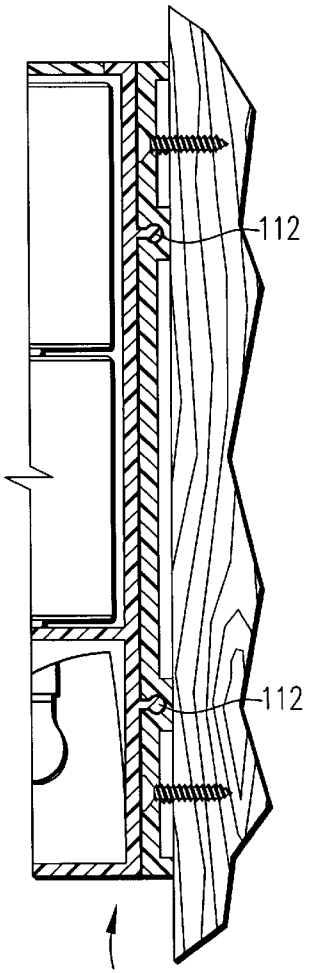
FIG. 11
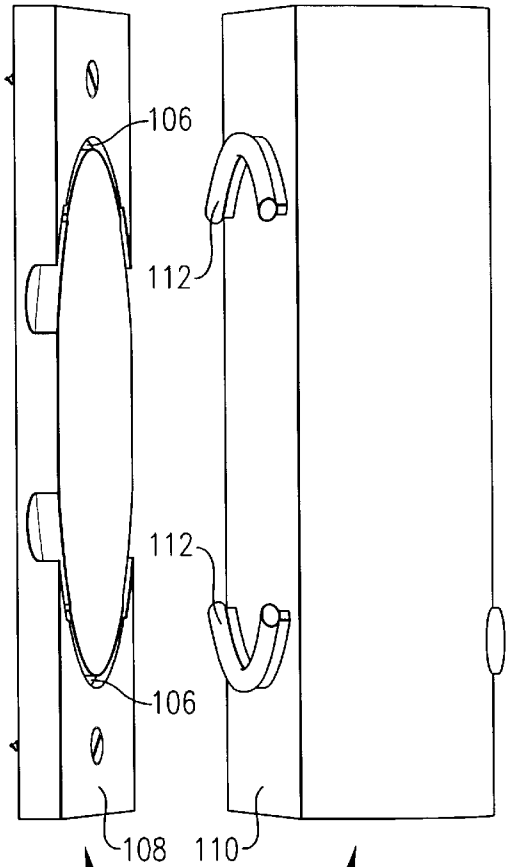
FIG. 10
FIG. 9
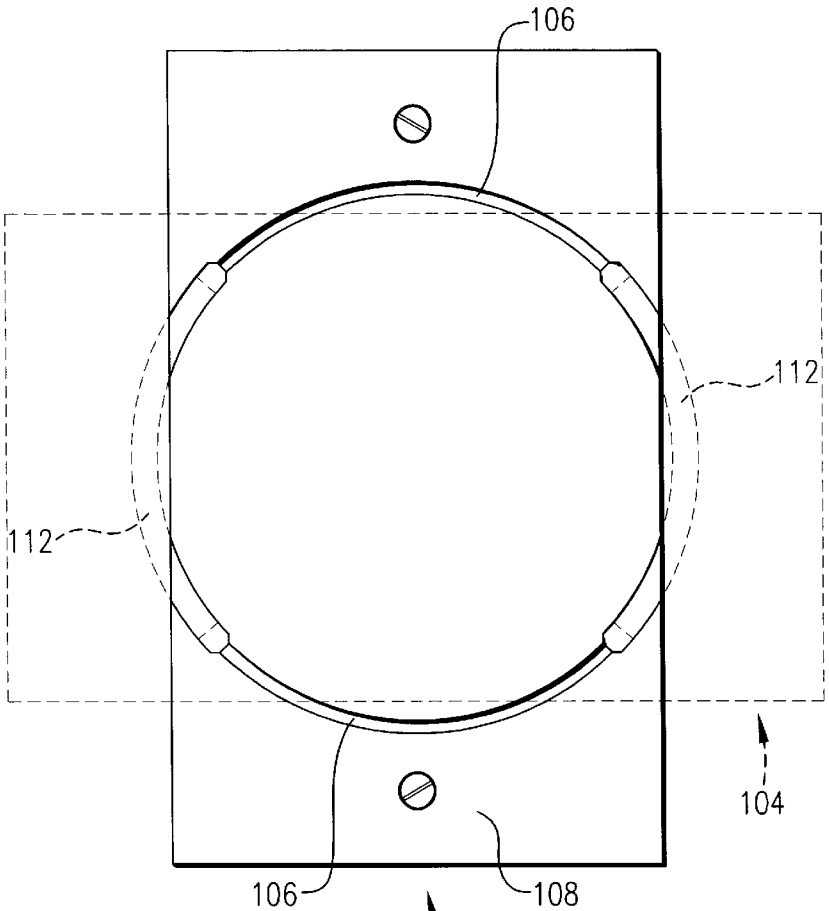
FIG. 8

THEFT-PROOF REMOVABLE DOOR HANDLE ILLUMINATION DEVICE

RELATED APPLICATION

The Inventors hereby claim the benefit under Title 35 United States Code, §119(e) of application for U.S. Letters Patent Serial No. 60/157,527 filed Oct. 4, 1999, which is hereby incorporated by reference herein.

BACKGROUND OF THE INVENTION

1. Field of the Invention

The present invention relates generally to entry doors. More particularly, the present invention concerns a theft-proof device that is operable to illuminate hardware (e.g., the handle) of a door and is removable for use as a flashlight. That is to say, the inventive door illumination device illuminates :the door hardware and has means to allow the device to be removed from the mounting surface when the door is open—to allow the device to be put to other illumination uses—but prevents the removal of the device from the mounting surface when the door is closed.

2. Discussion of Prior Art

Those ordinarily skilled in the construction industry will appreciate that door handle illumination devices are commonly used in industry and in many households. However, there are many problems associated with conventional door handle illumination devices. For example, door handle illumination devices are traditionally fixed to the mounting surface so as not to be removable from the mounting surface. That is to say, the only use of traditional door handle illumination devices is to illuminate a door handle associated near the devices permanent, fixed location. This is particularly problematic in household applications, wherein it would be beneficial to have an illumination device that could both illuminate the door handle and be easily removed from the mounting surface to provide other illumination uses (e.g., a flashlight to illuminate a dark house during a power failure). Removability of door handle illumination devices presents another problem involving ease of theft or vandalism. That is to say, because door handle illumination devices are typically located near an exterior door handle, if the device is easy for the user to remove from the exterior mounting surface, thieves and vandals can easily remove the device as well.

OBJECTS AND SUMMARY OF THE INVENTION

Responsive to these and other problems, an important object of the present invention is to provide a highly effective door hardware illumination device that can also be put to other illumination uses (e.g., a flashlight). That is to say, an important object of the present invention is to provide a door hardware illumination device that is both easily removable from the mounting surface and operable to illuminate when not associated with the mounting surface. Another important object of the present invention is to provide a theft-proof removable door hardware illumination device. That is, it is an important object of the present invention to provide a door hardware illumination device that is both easy for the user to remove from the mounting surface when the user desires to put the device to other illumination uses, and yet virtually impossible to remove from the mounting surface when the user does not desire to put the device to other illumination uses (e.g., when the user is not at home and the door is closed).

In accordance with these and other objects evident from the following description of the preferred embodiment, the present invention concerns a theft-proof removable door hardware illumination device comprising a base, operable to mount on a mounting surface, a door hardware illumination assembly operable to provide illumination, and a case supporting the assembly. The case and base are removably interconnected in such a manner that disconnection of the case from the base requires movement of the case in a disconnect direction that is at least substantially parallel to the mounting surface. The case and base cooperate when interconnected to prevent movement of the case in a direction generally perpendicular to the disconnect direction.

The device is further presented in combination with a door assembly including a door frame, a door hung on the frame for movement into and out of a closed position, and hardware selectively securing the door to the frame when the door is in a closed position. In the combination, the case and base are removably interconnected in such a manner that, when the door is closed, disconnection of the case from the base is prevented by interengagement of the case and door assembly, and permitted only when the door is open.

In this respect, it will be appreciated that the door hardware illumination device is both easy for the user to remove from the mounting surface when the user desires to put the device to uses other than illuminating the door hardware (e.g., as a flashlight once the door is open), and yet virtually impossible for thieves or vandals to remove from the mounting surface when the user does not desire to put the device to her illumination uses (e.g., when the user is not at home and the door is closed).

Other aspects and advantages of the present invention will be apparent from the following detailed description of the preferred embodiment and the accompanying drawing figures.

BRIEF DESCRIPTION OF THE DRAWING FIGURES

A preferred embodiment of the invention is described in detail below with reference to the attached drawing figures, wherein:

FIG. 8 is a front elevational view of an alternative embodiment of the present invention, showing the base in solid lines and the case in phantom lines and fully rotated relative to the base in the disconnect direction;

FIG. 9 is a perspective view of the base shown in FIG. 8;

FIG. 10 is a perspective view of the case shown in phantom in FIG. 8;

FIG. 11 is a vertical cross-sectional view of the alternative embodiment, mounted to a door, showing the interlocking connection of the case and base.

DETAILED DESCRIPTION OF THE PREFERRED EMBODIMENTS

Figure 1:
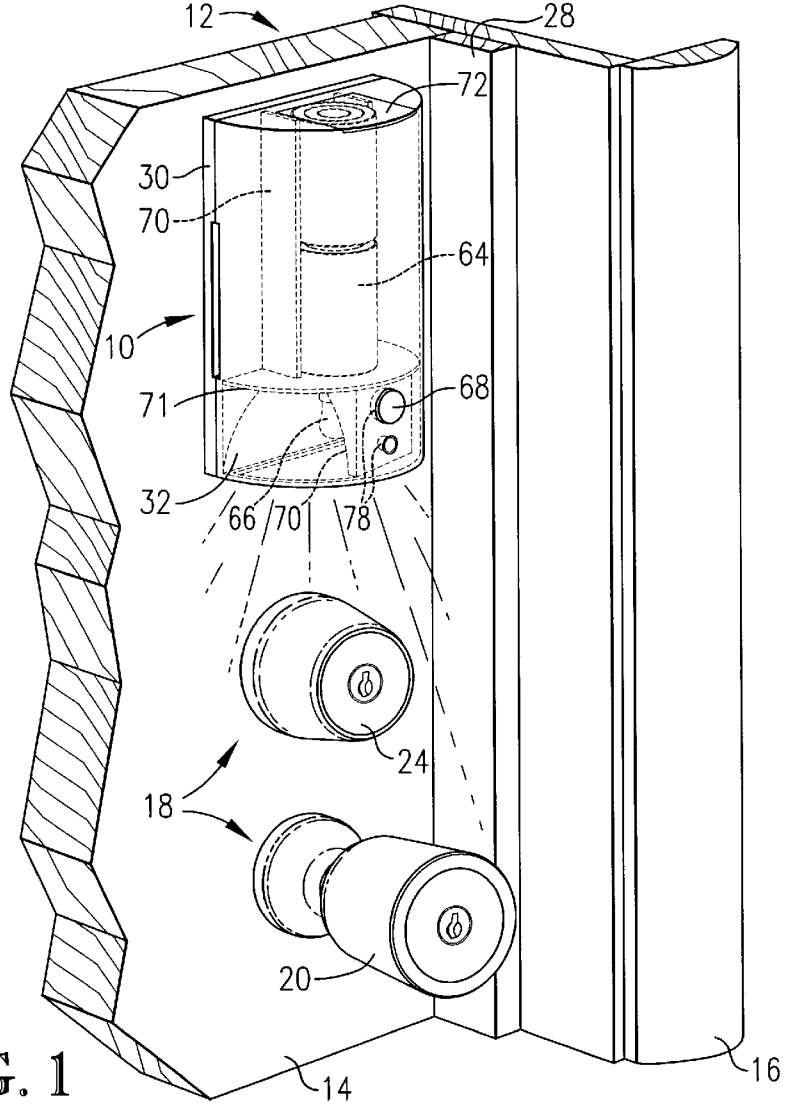
FIG. 1 is a perspective view of a theft-proof removable door hardware illumination device constructed in accordance with the principles of the present invention and mounted on the door of a door assembly, with the door being shown in the closed position.

Turning initially to FIG. 1, the theft-proof removable door handle illumination device 10 selected for illustration generally is associated with a door assembly 12. The door assembly 12 includes a door 14, a door frame 16 and hardware 18. The door 14 hangs from the frame 16 by hinges (not shown) that movably support the door 14. The door 14 closes into and opens out of the frame 16. The hardware 18 includes a door handle 20, with handle latch 22, and a keyhole 24 with keyhole lock 26. The lock 26 selectively and securely affixes the door 14 to the frame 16. The handle 20 facilitates opening and closing the door 14 and, as is common, the handle 20 operates the latch 22 that serves to releasably retain the door 14 in the closed position. The frame 16 includes a pair of spaced apart jambs 28 (only one of the jambs being shown in the drawing figures) between which the door 14 is located when in the closed position. The device 10 is shown mounted on the door 14, illuminating the hardware 18. As will become clear from the following description, the device 10 could also be mounted to the frame 16, including on the jamb 26. In addition, the device 10 could be mounted on a surface in close enough proximity to the door assembly 12 to allow both illumination of the hardware 18 and, as will become apparent, interengagement of the device 10 and the door assembly 12. The door assembly 12 is preferably a home exterior door assembly, however, the scope of the present invention encompasses use of, the device in virtually any door assembly, for example, home interior, building interior and exterior, or vehicle door assemblies (such as door assemblies on recreational vehicles).

Figure 5:
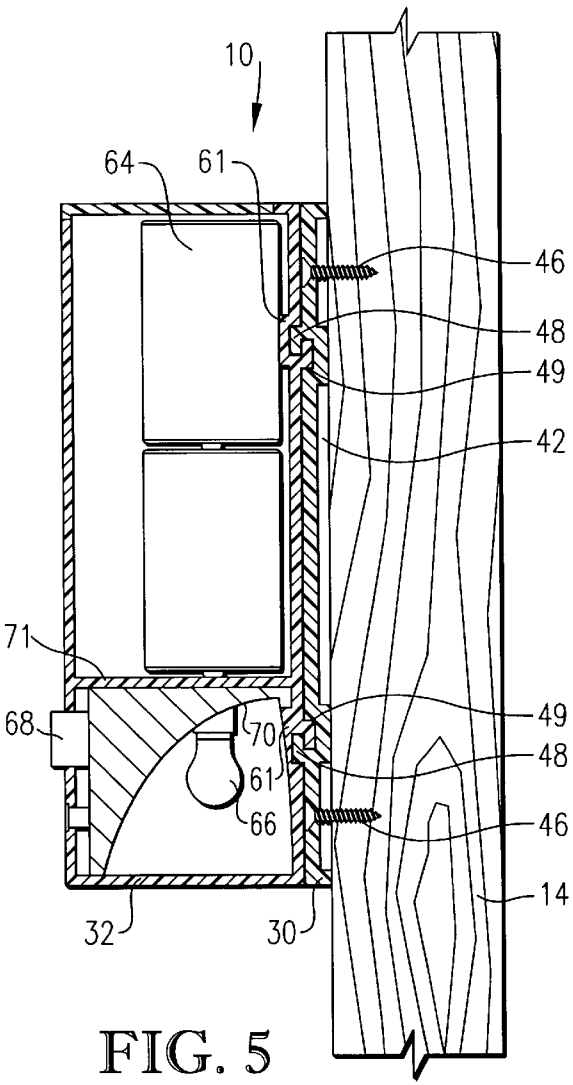
FIG. 5 is a vertical cross-sectional view of the device shown in FIG. 1, particularly showing the interlocking connection of the case and base.
Figure 3:
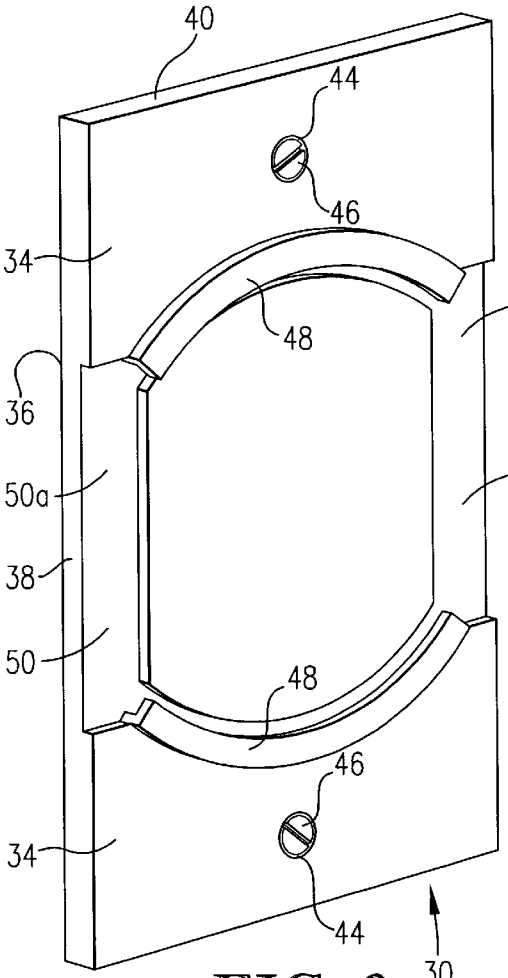
FIG. 3 is a perspective view of the base of the device shown in FIG. 1.

The device 10 includes a base 30 and a case 32. The case 32 is removably interconnected to the base 30. The base 30 (see FIG. 3) is rectangular in shape and includes a front surfaces 34 and a back surface 36. Extending between the front surface 34 and the back surface 36 are side walls 38 and opposing ends 40. The base 30 must be sufficiently dimensioned, both with respect to surface area and thickness, to sufficiently support the case 32 when the base 30 is mounted on a mounting surface. The illustrated base 30 is approximately the size of a standard household single outlet cover-plate. The illustrated base 30 and case 32 have roughly equal length and width dimensions. The base 30 is preferably constructed out of molded plastic. To reduce the amount of material used, and to facilitate the molding process, recesses 42 (see FIG. 5) located between the points of contact formed by the back surface 36 and the mounting surface are provided.

The base 30 could be any shape and size, so long as it can sufficiently support the case 32. For aesthetic purposes, a base 30 dimensioned equal to or smaller than the case 32 dimensions would allow the base 30 to be hidden by the case 32 when the case 32 is interconnected with the base 30. The base 30 could be constructed of any suitable material or combination of materials, e.g. various types of plastics, metals or woods. The base 39 may also be any suitable configuration—e.g. solid, hollow, or a combination—so long as the base 30 when mounted on a mounting surface can sufficiently support the case 32.

The base 30 has screw receiving openings 44 that receive screws 46. The screw receiving openings 44 each have a countersunk configuration whereby the outer edge of the opening 44 located on the front surface 34 are larger than the inner edge of the opening 44 located on the back surface 36. This countersunk configuration forms a funnel-shape for receiving the complementally shaped head of the screw 46. The funnel-shape allows the head of the screw 46 to lay flush with the front surface 36 when the base 30 is mounted to a mounting surface. Any type of fastener sufficient to affix the base 30 to a mounting surface and support the weight of the device 10 could be utilized, for example bolts, glue, nails, rivets.

The base 30 includes attachment flanges 48 projecting from the front surface 34 on opposite sides of the horizontal centerline of the base 30. The attachment flanges 48 preferably extend along diametrically opposed arcs of a common imaginary circle having a center point common with the geometrical center of the surface 34. Each attachment flange 48 extends about approximately one-quarter of the imaginary circle (i.e., an arc of about 90°). Further, each of the illustrated attachment flanges 48 has an inverted L-shaped cross-section relative to the front surface 34 (see FIG. 5). The inverted L-shaped flanges 48 each cooperate with a respective grooved projection 49 to define a receiving channel in which a complemental portion of the case 32 is received. The projections 49 are preferably coextensive with the flanges 48. The projections 49 extend to and define in part the back surface 36. In this regard, it may be said that the receiving channels project generally inward from the front surface 34. As will be described, the shape of the flanges 48 may be varied as desired, as long as the flanges 48 cooperate with the corresponding structure of the case 32 to provide the desired interconnection.

The base 30 further includes a pair of side cavities 50 recessed below the front surface 34. Each of the cavities 50 projects from corresponding ends of the receiving channels to the adjacent one of the side walls 38 (see FIG. 3). The illustrated cavities 50 each consequently spans the portion of the length of the base 30 extending between the attachment flanges 48. The cavities are defined by a recessed wall 50*a* that is preferably coplanar with the inner margin of the receiving channels.

Figure 4:
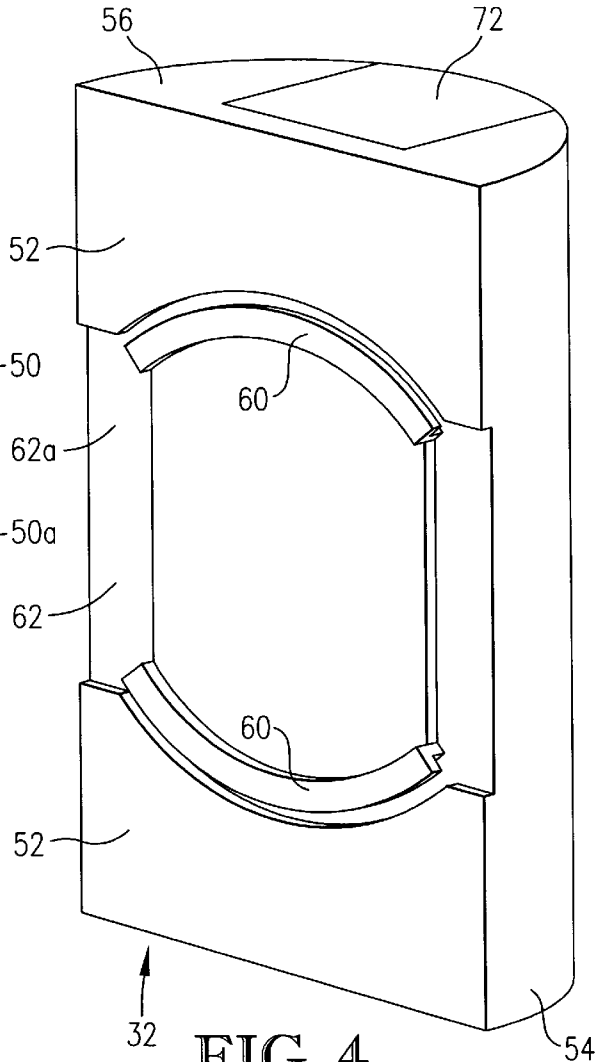
FIG. 4 is a perspective view of the back of the case of the device shown in FIG. 1.

The case 32 (see FIG. 4) is half-cylindrical in shape and includes an aft surface 52, an apron 54, a top plate 56 and a bottom plate 58. Similar to the base 30, the case 32 includes attachment flanges 60 projecting from the aft surface 52 on opposite sides of the horizontal centerline of the aft surface 52. In addition, the attachment flanges 60 similarly extend along diametrically opposed arcs of a common circle, with the arcs each being approximately 90° in length. It is noted that the radius of the common circles (for both sets of flanges 48 and 60) are equal. Yet further, each of the flanges 60 have a shape complemental to the respective receiving channel defined in the base 30; that is, the illustrated flanges 60 each present an inverted L-shaped cross-section relative to the aft surface 52. The case 32 also includes a similar pair of projections 61 that cooperate with the flanges 60 to define receiving channels, each of the channels being configured to receive the respective attachment flange 48 of the base 30. In other words, the illustrated channels of the case 32 present an L-shaped cross-section complemental to the shape and size of the attachment flanges 48 of the base 30.

Again, it is entirely within the ambit of the present invention to vary the shape, dimension and configuration of the channels and flanges so long as the desired interconnection between the base 30 and case 32 is provided. For example, the principles of the present invention are equally applicable to an alternative device having the upper set of flanges and channels different from the lower set. It will be appreciated that such an alternative configuration ensures that the case is always properly oriented right-side-up on the base (i.e., with the top plate 56 facing upwardly and the bottom plate 58 facing downwardly). It is also entirely possible to configure adjacent flanges (e.g., the upper attachment flanges of the case and base) differently. For example, the upper attachment flange of the base may alternatively have a T-shaped cross-section, while the upper attachment flange of the case may alternatively have a J-shaped cross-section. Of course, such an alternative arrangement requires the receiving channel for each of the flanges to be complementally configured.

As is also similar to the base 30, the case 32 includes a pair of side cavities 62 recessed below the aft surface 52. Each of the cavities 62 projects from corresponding ends of the receiving channels to the adjacent side edge of the aft surface 52 (see FIG. 4). The illustrated cavities 62 each consequently spans the portion of the length of the case 32 extending between the attachment flanges 60. The cavities are defined by a recessed wall 62*a* that is preferably coplanar with the inner margin of the receiving channels.

In the preferred embodiment, the case 32 houses an illumination assembly 74 that is operable to provide selective illumination. The illustrated assembly 74 includes a portable power source 64, a replaceable lightbulb 66, and a normally open circuit (not shown) interconnecting the power source 64 and lightbulb 66. Interposed along the circuit is a push-button type switch 68 that operates to alternatively open and close the circuit when depressed. The configuration of the switch 68 may be varied as desired, with any type of suitable circuit control device being usable. A motion sensor 69 is also suitably provided along the circuit to activate the circuit and thereby turn the lightbulb on when the presence of a person adjacent the door 14 is sensed. It is noted that the switch 68 and sensor 69 are preferably located in suitable openings 78 of the apron 54 so as to face outwardly when the case 32 is supported on the base 30. A secondary switch (not shown) may also be provided to permit manual control of the sensor 69, as it will likely be desirable to deactivate the sensor when the case 32 and assembly 74 are being used for portable illumination.

The case 32 is generally hollow so that the illumination assembly 74 is essentially contained entirely within the case 32. However, the principles of the present invention are equally applicable to only partial enclosure or encasement of the illumination assembly by the case 32 (e.g., some or all of the illumination assembly may be supported externally of the case 32). As discussed above with respect to the base 30, the case 32 could be any shape and size, so long as the illumination assembly 74 could be incorporated in the case 32 and the case 32 can be removably interconnected to the base 30. For aesthetic purposes, a base 30 dimensioned equal to or smaller than the case 32 dimensions would allow the base 30 to be hidden by the case 32 when the case 32 is coupled to the base 30. In addition, as a practical matter, because the case 32 is designed to be removable and usable for portable illumination, the size and shape of the case 32 should facilitate this portable usage. In fact, it is, entirely within the ambit of the present invention to provide an alternative case configuration (e.g., a case with a grip handle) that is more easily held. The case 32 could be constructed of any suitable material or combination of materials, e.g. various types of plastics, metals or woods. The material design could also be any suitable configuration (e.g., solid, hollow, or a combination) subject to the same two limitations discussed above.

The lightbulb 66 is oriented at the bottom of the case 32 toward the bottom plate 58 so that when the circuit is closed (i.e., when the button switch 68 is pushed to the on position or the motion sensor senses movement of person or a storm door) a beam of light is emitted. In the illustrated embodiment, the bottom plate 58 is transparent, although the bottom plate 58 could be variously configured to allow the beam of light to penetrate (e.g., the bottom plate 58 could be constructed of opaque material with a light-directing opening configured to direct the beam of light). If desired, the apron 54 and/or the bottom plate 58 maybe removably connected to the aft surface 52 so as to allow access to the illumination components housed within the case 32. It is further noted that a dividing wall 71 is located between the power source 64 and the light 66 and a reflective canopy is fixed adjacent the wall 71 to enhance the directional illumination provided by the device (see FIG. 5).

The portable power source 64 in the illustrated embodiment is a pair of batteries (e.g., D-size batteries), preferably rechargeable, although other suitable power sources may be used. The power source 64 must supply sufficient power to the lightbulb 66 to generate the desired degree and duration of light. However, it is most preferred to utilize a portable power source 64 (i.e., a power source that is operable when the case 32 is removed from the base 30). For example, a single, relatively small battery could be used in combination with a battery charger provided in the base 30, wherein the charger is activated and charges the battery when the case 32 is coupled to the base 30. The charger could be directly connected to a normally closed, continuous power supply (e.g., the master circuit of the building or house). A removable cover 72 is provided on the case 32 to facilitate replacement of the preferred power source 64 (see FIG. 4). In the illustrated embodiment, the cover 72 comprises a portion of the top plate 56 and is snap fit into place. If desired, the orientation of the cover 72 may be reversed so that it projects from the aft surface 52 and is spaced from the apron 54. Such an alternative arrangement permits removal of the cover essentially only when the case 32 has been removed from the base 30, thereby further enhancing the theft-proof nature of the device.

The lightbulb 66 can be any suitable, commonly available, replaceable bulb of varying wattage, size, shape and color, subject to the limitation that the bulb 66 provide enough light to sufficiently illuminate the targeted hardware 18. In this regard, the device 10 must be mounted in close enough proximity to the targeted hardware 18 to sufficiently illuminate the door handle 20 and/or the keyhole 24 so as to facilitate grasping of the handle 20 and unlocking of the lock 26 in low-light conditions (see FIG. 1).

Turning now specifically to the removable interconnection of the base 30 and case 32, the attachment flanges 48, 60 and corresponding receiving channels provide smooth and uncomplicated connection and disconnection of the base 30 and case 32, while ensuring that the case 32 may be securely locked on the base 30. That is to say, the device 10 is designed so that the case 32 is easily and quickly removable so that the illumination assembly 74 may be used in various portable applications, but removal of the case 32 is prevented except in certain conditions (e.g., when the door 14 is open).

Figure 2:
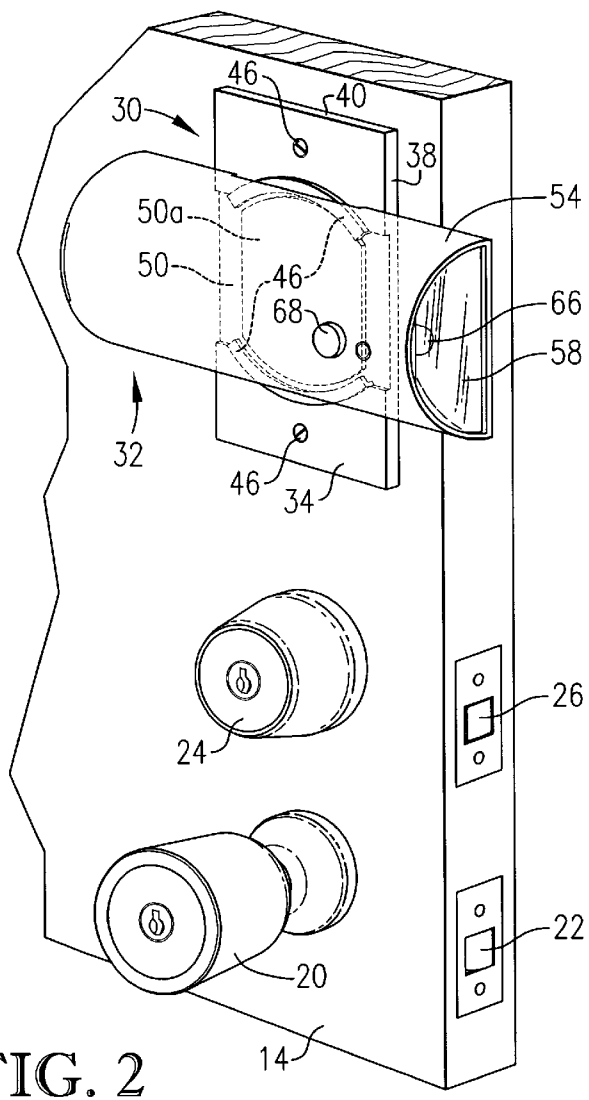
FIG. 2 is a perspective view of the device shown in FIG. 1, particularly illustrating the door in an open position and the case sufficiently moved in the disconnect direction to permit removal from the base.

As perhaps best shown in FIG. 2, attachment of the case 32 to the base 30 first requires the door 14 to be open; otherwise, the door frame 16 will obstruct the case 32 from being installed. Once the door 14 is sufficiently open, the case 32 is positioned in a transverse orientation relative to the base 32 and the aft surface 52 thereof is placed against the front surface 34 of the base 30. It is noted that the geometrical centers of the surfaces 34 and 52 must also be generally aligned. In this orientation, the illustrated attachment flanges 48 and 60 form a continuous circle (so do the receiving channels). The case 32 is then rotated approximately ninety degrees (90°) in a clockwise direction so that the case 32 is generally aligned with the base 30, with the top plate 56 oriented upwardly and the bottom plate 58 oriented downwardly (see FIG. 1). Of course, if the case 32 happened to be facing the opposite direction in FIG. 2 (such that the top of the case 32 projects beyond the adjacent side of the door 14), the case 32 would alternatively be turned in a counter-clockwise direction.

Those ordinarily skilled in the art will appreciate that placement of the aft surface 52 flatly against the front surface 34 (as shown in FIG. 2) is permitted because the side cavities 50 and 62 receive the flanges 60 and 48, respectively, without requiring longitudinal movement of the flanges. However,. as soon as the base 30 and case 32 are interconnected (i.e., as soon as the flanges 48 and 60 have been received in the respective channels) such non-axial movement of the flanges 48 and 60 is prevented. As perhaps best shown in FIG. 1, the cavities 50 and 62 define a slight gap extending along each side of the device when the case 32 is supported on the base 30. As will be indicated by the alternative embodiment, such a gap may be eliminated.

It is noted that the screw openings 44 are located in the base 30 so that the screws 46 are not exposed once the case 32 is rotated into contact with the door frame 16 (see FIG. 6). it is therefore important with the illustrated embodiment that the base 30 is mounted sufficiently close to the frame 16 to ensure that the case 32 is prevented from rotating enough to expose the screws 46. Of course, the principles of the present invention are equally applicable to other screw opening locations. For example, the openings may alternatively be located between the flanges 48 (i.e., within the imaginary circle), which would ensure that the screws are only exposed once the case 32 is removed.

If desired, the base 30 and/or case 32 may be provided with a stop (not shown) that prevents movement of the case 32 beyond the aligned relationship with the base 30. It may also be desirable and possible to provide a catch (e.g., a detent mechanism) that releasably holds the case 32 in the aligned relationship. In the illustrated embodiment, however, the flanges 48,60 and channels are tightly dimensioned so that each flange is snugly received in the respective channel and the frictional interengagement provided thereby prevents inadvertent rotation of the case 32 relative to the base 30.

Figure 7:
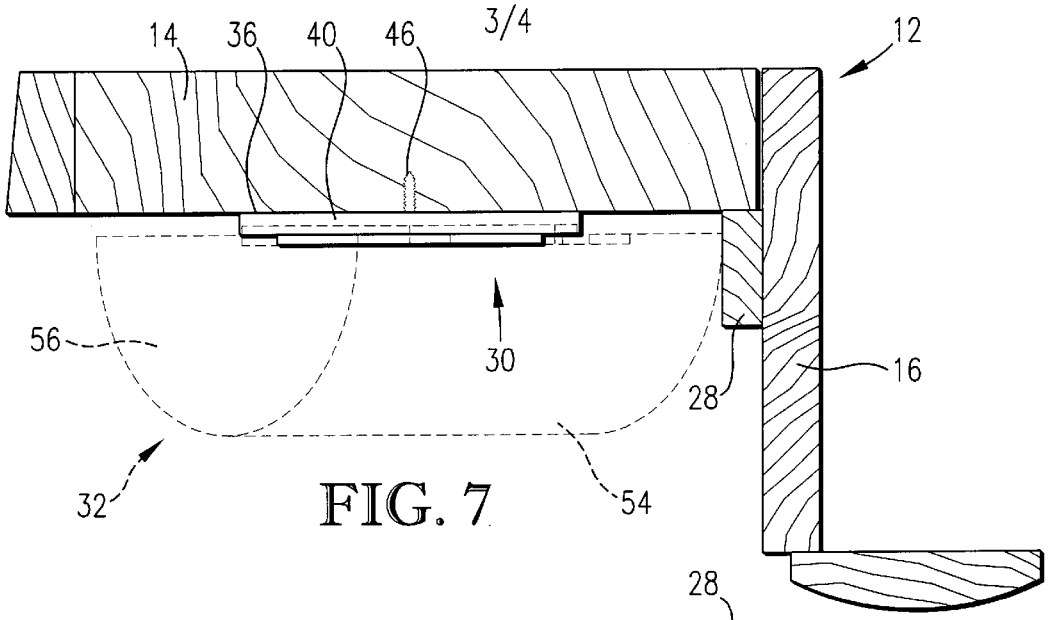
FIG. 7 is a horizontal cross-sectional view of the depiction of FIG. 6.
Figure 6:
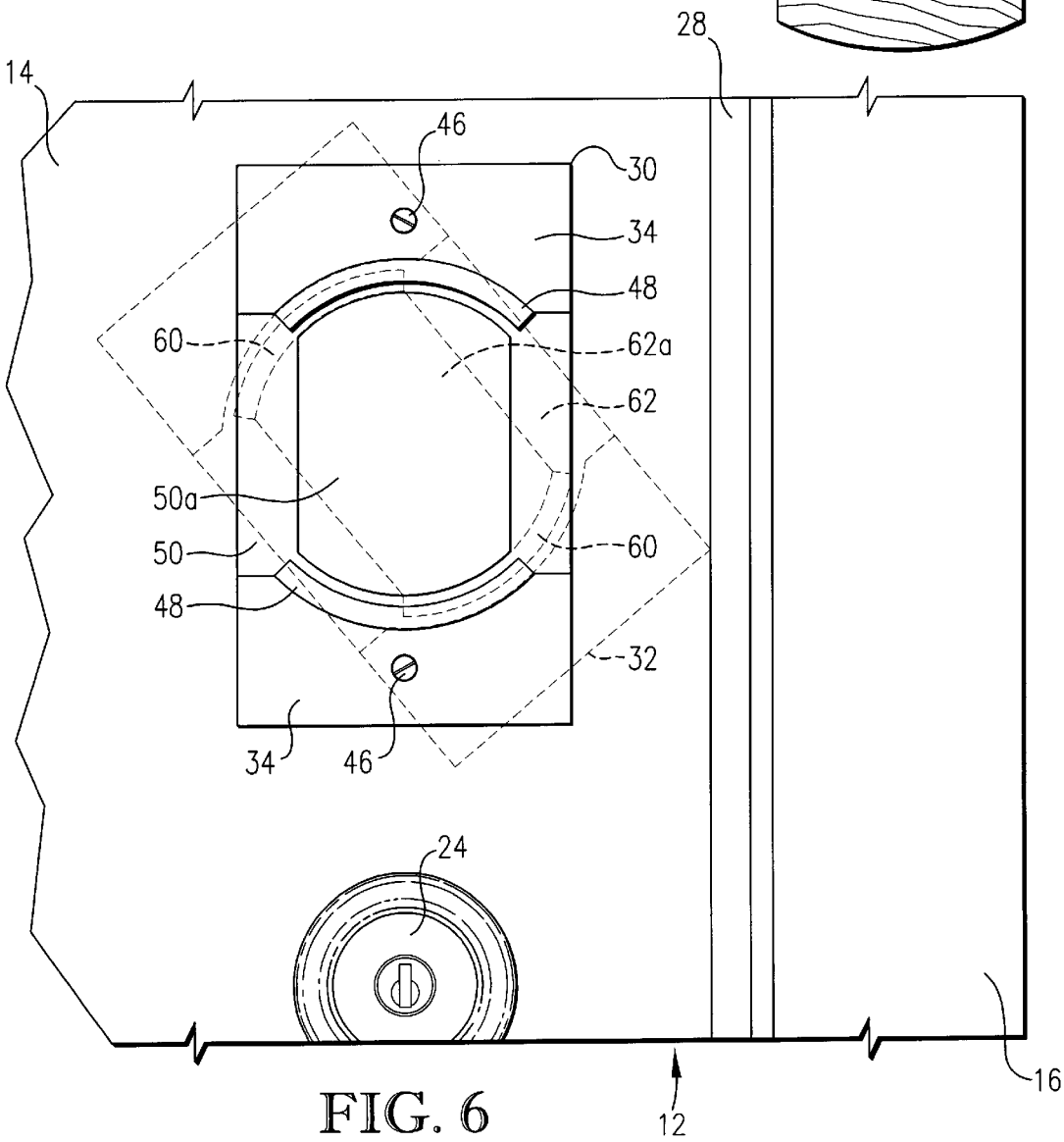
FIG. 6 is a front elevational view of the base of the device shown in FIG. 1, particularly showing the door in the closed position and the case in phantom lines as it rotates in the disconnect direction and is prevented from being removed from the base by engaging the door frame.

Once the door 14 is closed as shown in FIGS. 6 and 7, the case 32 can only be rotated only slightly out of the aligned position before engaging the door frame 16. In this regard, the case 32 is prevented from rotating fully to the transverse position shown in FIG. 2. This, of course, requires the base 30 to be mounted sufficiently close to the door frame 16. It also requires the device 10 to be designed so that removal of the case 32 involves movement in a direction that causes such blocking interengagement with the door frame 16. In other words, because the case 32 is prevented from moving generally perpendicular to this disconnect direction when the flanges 48,60 are received in their respective channels, the case 32 cannot simply be pulled away from the base 30. In view of the foregoing, the case 32 can only be removed when the door 14 has been opened and sufficiently cleared the door frame 16, such that only a person capable of opening the door 14 (e.g., a homeowner having the key to operate the lock 26) can utilize the case 32 and illumination assembly 74 apart from the hardware 18. It is believed that such a limitation significantly reduces the risk of theft of the case 32 and assembly 74, while ensuring that the device 10 effectively illuminates the hardware 18.

Preferably, the base 30 is relatively flat and is mounted flush against a flat surface of the door 14 (see FIG. 1). Therefore, the case 32 preferably connects and disconnects from the base 30 by movement in a direction that is parallel to both the door 14 and to the base 30. It is well within the ambit of the present invention that the base 30 could alternatively be mounted to a non-flat surface(s). For example, the device may alternatively be mounted to a door or frame that is somewhat contoured or curved. In addition, it is well within the ambit of the present invention that the base 30 could alternatively be variously shaped and sized (e.g., bowl shaped). It is also possible for the device to be configured so that movement of the case 32 in the disconnect direction is at a slight angle relative to the surface to which the base is mounted. It will be appreciated that such relative angular movement is still sufficiently parallel to the mounting surface that the case 32 will be caused to engage the door frame 16 when the door 14 is closed. Accordingly, movement of the case 32 in the disconnect direction may not be exactly parallel with either or both the mounting surface and the base 30, although such movement is at least substantially parallel to the mounting surface. An additional alternative embodiment involves limited or slight movement of the case 32 away from the mounting surface (e.g., the base and the case may be threadably interconnected). Such screwing interaction between the base and case is still considered to involve substantially parallel movement of the case relative to the mounting surface. It would also be possible to provide a linear tongue and groove connection between the base and case, such that the case moved in a straight disconnect direction rather than rotate as illustrated. It will be appreciated that such a linear connection would likely be associated with a stop that permits movement of the case in only a single direction (i.e., toward to door frame) out of the fully engaged condition with the base.

As noted, the base 30 is preferably mounted to the door 14. However, the device 10 may alternatively be mounted on any surface close enough to sufficiently illuminate the targeted hardware 18. For example, the device can alternatively be mounted on the door frame 16 such that the door in its closed position interferes with rotation of the case relative to the base. It is only important that the device provide the desire illumination of the hardware 18, while permitting the case to be quickly and easily removable only certain conditions (e.g., when the door is closed).

An alternative embodiment 100 of the invention is shown in FIGS. 8–11. The device 100 is substantially similar to the embodiment shown in FIGS. 1–7, except that the base 102 and case 104 are removably interconnected by an alternative tongue and groove connection. Particularly, a pair of grooves 106 project inwardly from the front surface 108 of the base 102. As before, the grooves 106 extend along diametrically opposed arcs of an imaginary circle centered on the front surface 108. Projecting from the aft surface 110 of the case 104 are a pair of tongues 112. The tongues are likewise defined along diametrically opposite arcs of an imaginary circle centered on the aft surface 110. The imaginary circles along which the grooves 106 and tongues 112 extend are equal in size. Furthermore, the common diameter of these imaginary circles is greater than the width of the base 102. Each of the grooves 106 extend more than ninety degrees (90°) around the imaginary circle and thereby extend from side to side. On the other hand, the tongues 112 each extend only about ninety degrees (90°) around the imaginary circle. It is noted that the base 102 and case 104 do not each include both a tongue and groove (or a flange and channel).

In addition, the grooves 106 and tongues 112 have an alternative configuration; that is, they are not L-shaped in cross-section. Instead, each groove 106 has an inverted bulb-shaped cross-section (i.e., a circular opening with a radial projection extending therefrom) relative to the front surface 108 (see particularly FIG. 11). The tongues 112 have a cross-sectional shape corresponding to that of the grooves 106. As best shown in FIG. 8, the ends of each of the grooves are widened (i.e., the portion of the base defining the narrow outer section of the groove is removed) so as to not prevent non-axial movement of the tongue 112 relative thereto. In this regard, the aft surface 110 of the case 104 can be placed flatly against the front surface 108 of the base 102 when the case 104 is oriented in a transverse relationship relative to the base 102, as shown in FIG. 8.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A theft-proof removable door hardware illumination device comprising:

a base operable to be mounted on a mounting surface, a door hardware illumination assembly operable to provide illumination; and a case supporting the assembly, said case and base being removably interconnected in such a manner that disconnection of the case from the base requires movement of the case in a disconnect direction that is at least substantially parallel to the surface to which the base is mounted, said case and base cooperating when interconnected to prevent movement of the case in a direction generally perpendicular to the disconnect direction, said base has a generally flat configuration, said disconnect direction is substantially parallel to the base, said case and base being rotatably interconnected such that disconnection of the case from the base requires rotational movement of the case relative to the base in the disconnect direction.

2. A device as claimed in claim 1, said case and base cooperatively presenting a tongue and groove connection extending along the disconnect direction.

3. A device as claimed in claim 2, said groove projecting inwardly and including an outer section and a relatively wider, inwardly disposed inner section, said tongue presenting a shape complemental to the groove.

4. A device as claimed in claim 3, said tongue and groove each having an L-shaped cross-section.

5. A device as claimed in claim 1, said assembly including a portable power source.

6. A device as claimed in claim 5, said assembly including a replaceable light source selectively connectable to said power source.

7. A device as claimed in claim 6, said assembly including a switch that selectively controls the connection of the power source to the light source.

8. In combination:

a door assembly including a door frame, a door hung on the frame for movement into and out of a closed position, and hardware selectively securing the door to the frame when the door is in a closed position; and a theft-proof removable illumination device including a base mounted to the door assembly, a door hardware illumination assembly operable to provide illumination of the hardware, and a case supporting the illumination assembly, said case and base being removably interconnected in such a manner that, when the door is closed, disconnection of the case from the base is prevented by interengagement of the case and door assembly, said case and base being removably interconnected in such a manner that disconnection of the case from the base requires movement of the case in a disconnect direction that is at least substantially parallel to the surface to which the base is mounted, said case and base cooperating when interconnected to prevent movement of the case in a direction generally perpendicular to the disconnect direction, said base has a generally fat configuration, said disconnect direction is substantially parallel to the base, said case and base being rotatably interconnected such that disconnection of the case from the base requires rotational movement of the case relative to the base in the disconnect direction.

9. A combination as claimed in claim 8, said case and base cooperatively presenting a tongue and groove connection extending along the disconnect direction.

10. A combination as claimed in claim 9, said groove projecting inwardly and including an outer section and a relatively wider, inwardly disposed inner section, said tongue presenting a shape complemental to the groove.

11. A combination as claimed in claim 8, said base being mounted to the door.

12. A combination as claimed in claim 8, said illumination assembly including a portable power source.

13. A combination as claimed in claim 12, said illumination assembly including a replaceable light source selectively connectable to said power source.

14. A combination as claimed in claim 13, said illumination assembly including a switch that selectively controls the connection of the power source to the light source.

15. A theft-proof removable door hardware illumination device comprising:

a base operable to be mounted on a mounting surface, a door hardware illumination assembly operable to provide illumination; and a case supporting the assembly, said case and base being removably interconnected in such a manner that disconnection of the case from the base requires movement of the case in a disconnect direction that is at least substantially parallel to the surface to which the base is mounted, said case and base cooperating when interconnected to prevent movement of the case in a direction generally perpendicular to the disconnect direction said case and base being rotatably interconnected such that disconnection of the case from the base requires rotational movement of the case relative to the base in the disconnect direction.

16. A device as claimed in claim 15, said base having a generally flat configuration, said disconnect direction being substantially parallel to the base.

17. A device as claimed in claim 15, said case and base cooperatively presenting a tongue and groove connection extending along the disconnect direction.

18. A device as claimed in claim 17, said groove projecting inwardly and including an outer section and a relatively wider, inwardly disposed inner section, said tongue presenting a shape complemental to the groove.

19. A device as claimed in claim 18, said tongue and groove each having an L-shaped cross-section.

20. A device as claimed in claim 15, said assembly including a portable power source.

21. A device as claimed in claim 20, said assembly including a replaceable light source selectively connectable to said power source.

22. A device as claimed in claim 21, said assembly including a switch that selectively controls the connection of the power source to the light source.

23. In combination:

a door assembly including a door frame, a door hung on the frame for movement into and out of a closed position, and hardware selectively securing the door to the frame when the door is in a closed position; and a theft-proof removable illumination device including a base mounted to the door assembly, a door hardware illumination assembly operable to provide illumination of the hardware, and a case supporting the illumination assembly, said case and base being removably interconnected in such a manner that, when the door is closed, disconnection of the case from the base is prevented by interengagement of the case and door assembly, said case and base being rotatably interconnected such that disconnection of the case from the base requires rotational movement of the case relative to the base in a disconnect direction.

24. A combination as claimed in claim 23, said illumination assembly including a portable power source.

25. A combination as claimed in claim 24, said illumination assembly including a replaceable light source selectively connectable to said power source.

26. A combination as claimed in claim 25, said illumination assembly including a switch that selectively controls the connection of the power source to the light source.

27. A combination as claimed in claim 23, said disconnect direction being at least substantially parallel to the surface to which the base is mounted, said case and base cooperating when interconnected to prevent movement of the case in a direction generally perpendicular to the disconnect direction.

28. A combination as claimed in claim 27, said base having a generally flat configuration, said disconnect direction being substantially parallel to the base.

29. A combination as claimed in claim 27, said case and base cooperatively presenting a tongue and groove connection extending along the disconnect direction.

30. A combination as claimed in claim 29, said groove projecting inwardly and including an outer section and a relatively wider, inwardly disposed inner section, said tongue presenting a shape complemental to the groove.

31. A combination as claimed in claim 23, said base being mounted to the door.

* * * * *